US010368576B2

(12) United States Patent
Branton

(10) Patent No.: US 10,368,576 B2
(45) Date of Patent: Aug. 6, 2019

(54) ADDITIVE CARRYING COMPOSITION

(71) Applicant: British American Tobacco (Investments) Limited, London (GB)

(72) Inventor: Peter Branton, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 272 days.

(21) Appl. No.: 15/129,913

(22) PCT Filed: Mar. 27, 2015

(86) PCT No.: PCT/GB2015/050923
§ 371 (c)(1),
(2) Date: Sep. 28, 2016

(87) PCT Pub. No.: WO2015/145165
PCT Pub. Date: Oct. 1, 2015

(65) Prior Publication Data

US 2017/0156395 A1 Jun. 8, 2017

Related U.S. Application Data

(63) Continuation of application No. PCT/GB2015/050923, filed on Mar. 27, 2015.

(30) Foreign Application Priority Data

Mar. 28, 2014 (GB) ..... 1405657.6

(51) Int. Cl.
*A24D 3/12* (2006.01)
*A24D 3/06* (2006.01)
(Continued)

(52) U.S. Cl.
CPC ..... *A24D 3/12* (2013.01); *A24B 15/30* (2013.01); *A24D 3/048* (2013.01); *A24D 3/061* (2013.01); *A24D 3/14* (2013.01)

(58) Field of Classification Search
None
See application file for complete search history.

(56) References Cited

U.S. PATENT DOCUMENTS 2,800,908 A * 7/1957 Blank ..... A24D 3/12 131/332
3,109,436 A 11/1963 Bavley
(Continued)

FOREIGN PATENT DOCUMENTS

EP 0014105 A2 8/1980
GB 1032330 8/1964
(Continued)

OTHER PUBLICATIONS

Menthol, Encyclopedia Britannica, no date, [online], retrieved from the Internet, [retrieved Aug. 17, 2018], <URL: https://www.britannica.com/science/menthol>. (Year: 2018).*
(Continued)

*Primary Examiner* — Dennis R Cordray
(74) *Attorney, Agent, or Firm* — Cantor Colburn LLP

(57) ABSTRACT

There is provided a composition for inclusion in a smoking article comprising an ion exchange resin and additive particles comprising an additive on the surface of the ion exchange resin. There is also provided a smoking article filter element comprising this composition, a smoking article comprising this smoking article filter element or this composition. A method of preparing a composition comprising an ion exchange resin and additive particles comprising an additive is also provided, the method comprising the depo-
(Continued)

sition of additive particles onto the ion exchange resin from the solid and/or liquid phase of an aerosol.

13 Claims, 2 Drawing Sheets

(51) Int. Cl.

| | |
|---|---|
| ***A24D 3/14*** | (2006.01) |
| ***A24D 3/04*** | (2006.01) |
| ***A24B 15/30*** | (2006.01) |

(56) References Cited

U.S. PATENT DOCUMENTS

| | | | | |
|---|---|---|---|---|
| 3,280,823 | A * | 10/1966 | Bavley | A24D 3/12 131/200 |
| 3,901,248 | A | 8/1975 | Lichtneckert | |
| 3,972,335 | A * | 8/1976 | Tiggelbeck | A24D 3/14 131/274 |
| 4,318,417 | A | 3/1982 | Hiroshi | |
| 6,119,699 | A * | 9/2000 | Sung | A24D 3/166 131/200 |
| 2003/0066539 | A1 | 4/2003 | Figlar | |
| 2004/0040565 | A1 | 3/2004 | Xue | |
| 2007/0023056 | A1 * | 2/2007 | Cantrell | A24B 15/165 131/194 |
| 2008/0142028 | A1 | 6/2008 | Fagg | |
| 2008/0245377 | A1 | 10/2008 | Marshall | |
| 2011/0271968 | A1 | 11/2011 | Carpenter | |

FOREIGN PATENT DOCUMENTS

| | | | |
|---|---|---|---|
| GB | 1286999 | | 8/1972 |
| WO | 9932002 | A1 | 7/1999 |
| WO | 2011121358 | A1 | 10/2011 |

OTHER PUBLICATIONS

Particle Size Conversion Table, Sigma-Aldrich, 2003,[online],retrieved from the Internet,[retrieved Mar. 29, 2017],<URL: http://www.sigmaldrich.com/chemistry/stockroom-reagents/learning-center/technical-library>. (Year: 2003).*

Branton et al, "Reduction of aldehydes and hydrogen cyanide yields in mainstream cigarette smoke using an amine functionalized ion exchange resin", Chem. Central J.,15 pages,[online],retrieved from the Internet, retrieved Aug. 21, 2018],<URL: https://www.researchgate.net/publication/50998822/download>. (Year: 2011).*

International Search Report for corresponding application PCT/GB2015/050923 filed Mar. 27, 2015; dated Jul. 31, 2015.

Written Opinion for corresponding application PCT/GB2015/050923 filed Mar. 27, 2015; dated Jul. 31, 2015.

* cited by examiner

ADDITIVE CARRYING COMPOSITION

FIELD

The present invention relates to compositions for inclusion in a smoking article and a method of preparing said compositions.

BACKGROUND

Smoking articles such as cigarettes often include adsorbent materials for removing compounds from tobacco smoke or delivering compounds to tobacco smoke. A range of adsorbent materials can be used, such as ion exchange resins.

SUMMARY

In accordance with a first aspect of the invention, there is provided a composition for inclusion in a smoking article comprising an ion exchange resin and additive particles comprising an additive on the surface of the ion exchange resin.

In some embodiments, the ion exchange resin has functional groups for ion exchange and the additive particles are not bonded to the functional groups.

In some embodiments the additive is released from the additive particles and at least some additive becomes entrained in the smoke being drawn through the smoking article upon use.

In some embodiments, the additive is a volatile or semi-volatile material.

In some embodiments, the additive is a flavour and/or aroma. In some embodiments, the flavour and/or aroma is a plant compound or derivative thereof, such as sandalwood, eucalyptus, anise, or cedar.

In some embodiments, the ion exchange resin comprises ion exchange resin beads.

In some embodiments, the ion exchange resin has one or more of the following properties: a mean bead diameter of from about 20 to about 1200 μm; a BET surface area of from about 10 to about 300 $m^2/g$; a mass density of from about 0.1 to about 1 $g/cm^3$; and a total exchange capacity of from about 0.5 to about 2 $meq/cm^3$. In some embodiments, the ion exchange resin comprises a polyamine type chelating resin such as a DIAION® CR20 resin (commercially available from Mitsubishi Chemicals) and/or a XORBEX® (commercially available from Dalian Trico Chemical Co. of China.

In accordance with a second aspect of the invention, a smoking article filter element is provided, wherein the smoking article filter element comprises a composition according to the first aspect.

In accordance with a third aspect of the invention, a smoking article is provided comprising a composition according to the first aspect, or a smoking article filter element according to the second aspect.

In accordance with a fourth aspect of the invention, a method of preparing a composition comprising an ion exchange resin and additive particles comprising an additive is provided, the method comprising the deposition of additive particles onto the ion exchange resin from the solid and/or liquid phase of an aerosol.

In some embodiments, the additive particles are deposited onto an ion exchange resin inside a closed chamber.

In accordance with a fifth aspect of the invention, there is provided a composition obtained or obtainable by a method according to the fourth aspect.

BRIEF DESCRIPTION OF DRAWINGS

Embodiments of the invention will now be described, by way of example only, with reference to accompanying drawings, in which.

DETAILED DESCRIPTION

Figure 1:
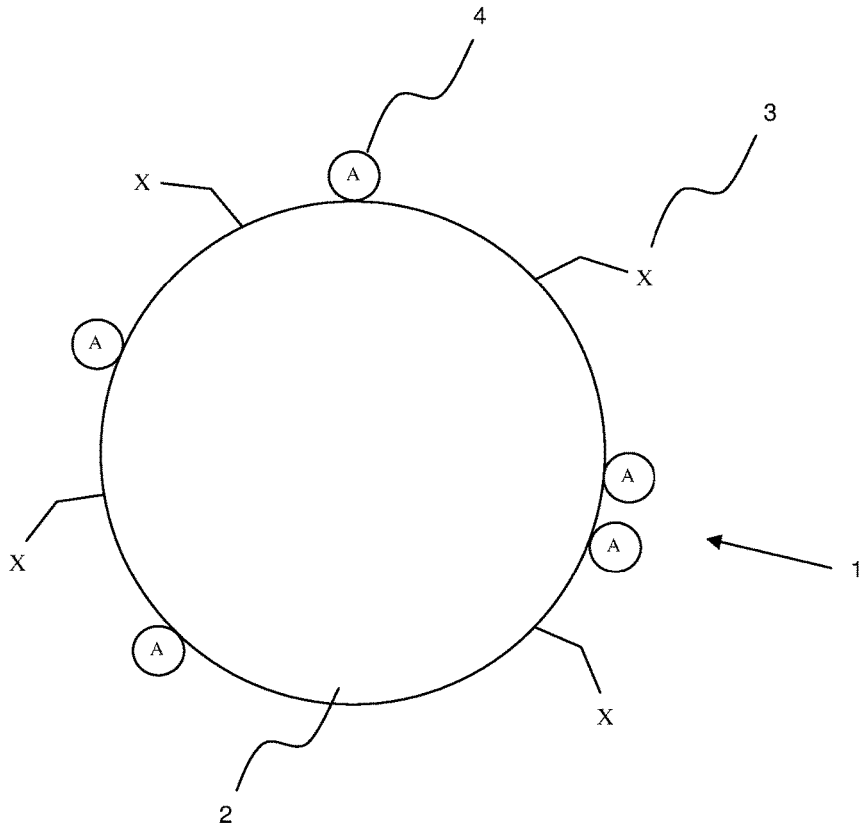
FIG. 1 is a schematic illustration of a composition according to one embodiment of the invention (not drawn to scale).

It is known to include ion exchange resins in cigarette filters for the purpose of modifying the composition of tobacco smoke. Sometimes, resins are included to deliver compounds to tobacco smoke. Sometimes, resins are included to remove constituents from tobacco smoke. In all cases, however, resins are included to modify the composition of tobacco smoke by delivering or removing compounds by ion exchange.

The compositions of the present invention comprise an ion exchange resin with particles on its surface for delivering to tobacco smoke an additive (i.e. additive molecules). In some embodiments, these additive particles attach to parts of the resin surface besides its functional groups. As a result, the resin is able to deliver additive whilst maintaining the ion exchange characteristics for filtration. This property provides the composition of the present invention with a number of advantages.

First, it prevents the functional groups of the resin being occupied, thereby leaving them free to remove compounds from tobacco smoke by ion exchange. This is especially useful where the functional groups of the resin are neutral and/or form particularly strong bonds with their ions. In short, leaving the functional groups of the resin free can minimise the extent to which having additive on the surface of the resin inhibits the ability of the resin to adsorb compounds from tobacco smoke.

Secondly, it facilitates the use of a different method for preparing a composition comprising an ion exchange resin for holding and releasing additive (i.e. for acting as a vector). As will be discussed in more detail further on, the composition of the present invention can be prepared by exposing an ion exchange resin to an aerosol comprising additive.

According to a first aspect, the present invention provides a composition for inclusion in a smoking article comprising an ion exchange resin having functional groups for ion exchange and additive particles on the surface of the ion exchange resin. In some embodiments, the additive particles are not bonded to the functional groups of the ion exchange resin.

The ion exchange resin of the composition can thus perform two functions. Firstly, it can carry and deliver additive molecules to tobacco smoke (i.e. it can act as a vector); and secondly, it can adsorb and remove smoke constituents from tobacco smoke.

Ion exchange resins are highly ionic, covalently cross-linked, insoluble polyelectrolytes. They are often supplied as porous beads or granules, their high surface area:volume ratio maximising the rate of ion exchange and the total ion exchange capacity. They can be precisely engineered to have a particular porosity and surface chemistry (i.e. surface functional groups for ion exchange), these features facilitating selective and effective ion exchange. They can be fabricated by cross-linking polymer molecules. In some cases, they can be made by cross-linking polystyrene using the cross-linking agent, divinylbenzene.

The composition of the present invention may comprise any ion exchange resin as long as it is suitable for incorporating into a smoking article and delivering additive molecules to tobacco smoke.

In some embodiments, the ion exchange resin may comprise ion exchange resin beads. In these embodiments, the beads may have any suitable size (i.e. diameter) and any suitable size distribution. In some embodiments, the beads may have a mean diameter of from about 20 to about 1200 μm, from about 100 to about 1100 μm, from about 200 to about 1000 μm, from about 300 to about 900 μm, from about 400 to about 800 μm, from about 500 to about 700 μm, or about 600 μm.

In some embodiments, the ion exchange resin may comprise porous ion exchange resin beads. In these embodiments, the beads may have any suitable porosity. The porosity of the beads may be precisely engineered by controlling the conditions used in resin synthesis, such as the concentration of the cross-linking agent. The porosity of the beads can affect the surface area:volume ratio of the resin. The ion exchange resin may have any suitable surface area:volume ratio, although in some embodiments it may be beneficial to maximise the surface area:volume ratio in order to maximise the rate of, and capacity for, ion exchange.

In some embodiments, the ion exchange resin may have a BET surface area of from about 10 to about 300 $m^2/g$. In some embodiments, the ion exchange resin may have a BET surface area of from about 15 to about 250 $m^2/g$, from about 20 to about 200 $m^2/g$, from about 25 to about 150 $m^2/g$, from about 30 to about 100 $m^2/g$, from about 35 to about 80 $m^2/g$, from about 40 to about 60 $m^2/g$, from about 45 to about 55 $m^2/g$, or about 50 $m^2/g$.

In some embodiments, the ion exchange resin may have a mass density of from about 0.1 to about 1 g/cm. In some embodiments, the ion exchange resin may have a mass density of from about 0.1 to about 0.9 g/cm, from about 0.2 to about 0.8 g/cm, from about 0.3 to about 0.7 g/cm, from about 0.4 to about 0.6 g/cm, or about 0.5 g/cm. In some embodiments, the ion exchange resin may have a total exchange capacity of from about 0.5 to about 20 $meq/cm^3$. In some embodiments, it may be beneficial to maximise the total exchange capacity to maximise the number of ions that can be adsorbed from tobacco smoke. In some embodiments, the resin may have a total exchange capacity of from about 0.1 to about 18 $meq/cm^3$, from about 0.5 to about 15 $meq/cm^3$, or from about 0.7 to about 10 $meq/cm^3$. In some embodiments, the total exchange capacity of the resin is from about 0.5 to about 2 $meq/cm^3$.

In some embodiments, the ion exchange resin may comprise one type of functional group. In other embodiments, it may comprise two or more types of functional group. Having one type of functional group may make the resin more selective in ion exchange, and result in a smaller range of ionic species being adsorbed. Having two or more functional groups may make the resin less selective in ion exchange, and result in a greater range of ionic species being adsorbed.

The functional groups of the resin may be anionic, cationic, and/or neutral. In some embodiments, they may be suitable for removing one or more compounds from tobacco smoke. In some embodiments, they may be suitable for removing one or more compounds from tobacco smoke which are undesirable for human inhalation. In some embodiments, they may be suitable for removing aldehydes, such as formaldehyde and acetaldehyde, and/or hydrogen cyanide from tobacco smoke.

In some embodiments, the composition of the invention comprises a DIAION® CR20 ion exchange resin. In some embodiments, the composition of the invention comprises a XORBEX® ion exchange resin. The surface chemistries and porosities of these resins make them highly effective for the selective adsorption of compounds from tobacco smoke.

It may be beneficial for the composition of the invention to comprise a DIAION® CR20 resin. DIAION® CR20 resins can be used in cigarettes to filter tobacco smoke because they can selectively and effectively remove compounds by ion exchange. They have amine functional groups with a high affinity for aldehydes and cyanides. They can thus selectively remove constituents from tobacco smoke that are undesirable for human inhalation, such as formaldehyde, acetaldehyde, and hydrogen cyanide.

In embodiments wherein the composition of the invention comprises a DIAION® CR20 to, the DIAION® CR20 resin may have any suitable properties. In some embodiments, the DIAION® CR20 resin may comprise beads with a diameter of from about 500 to about 700 μm, a density of from about 0.4 to about 0.6 g/cm, and a total exchange capacity of from about 0.5 to about 2 $meq/cm^3$. In some embodiments, the DIAION® CR20 resin may comprise beads with a diameter of about 600 μm, a density of about 0.5 g/cm, and a total exchange capacity of about 1 $meq/cm^3$.

FIG. 1, for the purpose of illustration and not limitation, shows a composition 1 according to some embodiments of the first aspect of the invention. The composition 1 comprises an ion exchange resin bead 2. The ion exchange resin bead 2 comprises functional groups 3 on its surface. Additive particles 4 are adsorbed to its surface. In the illustrated embodiment, the additive particles 4 are not bonded to the functional groups 3.

As shown in FIG. 1, the composition of the invention comprises an ion exchange resin with additive particles on its surface not bonded to its functional groups.

The additive included in the additive particles in the compositions of the invention is suitable for being delivered to tobacco smoke during smoking. Some or all of the additive may be released from the surface of the ion exchange resin and at least some of the additive may be picked up by the smoke being drawn through the smoking article upon use. The additive may be delivered to tobacco smoke as a gas or vapour. In some embodiments, the additive is released gradually over time. In some embodiments, the additive is released in an uncontrolled manner.

The additive particles on the surface of the ion exchange resin may have a homogeneous or heterogeneous molecular composition (i.e. they may form a pure sample of one molecule or a mixture of two or more molecules).

The additive may be delivered to tobacco smoke from the resin for any suitable purpose. In embodiments wherein the additive particles have a heterogeneous composition, the different molecules may be delivered for different purposes, and may be delivered at different rates and/or times. In some embodiments, the additive may comprise a flavourant and may be delivered to tobacco smoke to modify its flavour and/or aroma. Alternatively or in addition, the additive may comprise a diluent and may be delivered to tobacco smoke to dilute the concentration of certain constituents of the smoke.

As used herein, the terms "flavour" and "flavourant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamon, celery, cascarilla, nutmeg, sandalwood, coconut oil, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus *Mentha*), flavour enhancers, bitterness receptor site blockers, sensorial receptor site activators or simulators, sugars and/or sugar substitutes (e.g., sucralose, acesulfame potassium, aspartame, saccharine, cyclamates, lactose, sucrose, glucose, fructose, sorbitol, or mannitol), botanicals, or breath freshening agents. They may be imitation, synthetic or natural ingredients or blends thereof.

Diluents vaporise and transfer to the mainstream smoke in aerosol form. They are generally selected such that they transfer to the smoke substantially intact. Other components of the smoke (tobacco-derived components in the case of tobacco-containing smoking articles, or nicotine and/or flavour components in the case of non-tobacco-containing smoking articles) are therefore "diluted" by this means. In some embodiments, the diluent is at least one aerosol forming agent which may be, for instance, a polyol aerosol generator or a non-polyol aerosol generator, preferably a non-polyol aerosol generator. It may be a solid or liquid at room temperature. Suitable polyols include sorbitol, glycerol, and glycols like propylene glycol or triethylene glycol. Suitable non-polyols include monohydric alcohols, high boiling point hydrocarbons, acids such as lactic acid, and esters such as diacetin, triacetin, triethyl citrate or isopropyl myristate. A combination of diluents may be used, in equal or differing proportions. In some embodiments, triacetin, triethyl citrate and isopropyl myristate may be preferred.

In some embodiments, the additive may comprise volatile and/or semi-volatile molecules. This may increase the rate at which additive is released from the surface of the ion exchange resin as a gas or vapour. In some embodiments, the additive may readily volatilize, for example, under the conditions created upon the use of the smoking article. In some embodiments, the additive may comprise molecules with different volatilities. In some of these embodiments, the more volatile molecules may be released faster and/or earlier than the less volatile molecules. In some embodiments, this effect may be used to modify the composition of tobacco smoke in different ways at different times over the course of smoking.

In some embodiments, additive molecules may attach to themselves and/or other compounds besides the resin. In some embodiments, the additive molecules may attach to themselves and/or other compounds besides the resin to form solid particles on the surface of the resin.

In some embodiments, the presence of additive particles on the surface of the resin may inhibit the ability (i.e. rate and/or capacity) of the resin to exchange ions. In some embodiments, it may be beneficial to minimise this inhibitory effect. The extent to which having additive particles on the surface of a resin inhibits its ability to exchange ions can be quantified by comparing the total exchange capacity of the resin with additive particles (i.e. the composition of the invention) to the total exchange capacity of the resin without additive particles. In some embodiments, it may be beneficial to minimise the extent to which the presence of additive particles reduces the total exchange capacity. In some embodiments, the extent to which the presence of additive particles reduces the total exchange capacity may be less than about 90%, 80%, 70%, 60%, 50%, 40%, 30%, 20%, 10%, 5%, 1%, or 0.1%. In some embodiments, it may be less than about 50%. The number of primary amine groups is the most important feature for aldehyde and HCN removal from smoke and in some embodiments, the extent to which the additive particles reduce the availability of these groups for ion exchange is less than about 50%, 40%, 30%, 20%, 10%, 5%, 1%, or 0.1%.

Since the presence of additive particles on the surface of a resin can reduce the total exchange capacity, it may be beneficial to offset this effect by modifying features of the resin to increase its total exchange capacity. For example, it may be beneficial to increase the mass, porosity, and/or surface area of the resin to increase the total exchange capacity. Alternatively or in addition, the number of amine groups on the resin may be increased.

In some embodiments, features of the resin may be modified to increase the total exchange capacity as necessary to compensate, or more than compensate, for the reduction caused by the presence of additive particles. For example, in embodiments wherein the same mass of resin with additive particles (i.e. the composition of the invention) has a 50% lower total exchange capacity than the same mass of resin without additive particles, the resin with additive particles may be provided with a mass 50% greater than the mass of the resin without additive particles when incorporated into a smoking article.

According to a second aspect of the present invention, there is provided a filter element and/or filter comprising filter material and a composition according to the first aspect. These filter elements and filters may be incorporated into smoking articles.

Thus, the filter element and filter in accordance with the invention may comprise filter material, such as cellulose acetate tow, and a composition according to the present invention. In some embodiments, the composition comprises ion exchange resin beads. In some embodiments, the composition may be provided in a chamber or may be dispersed within the filter material. In other embodiments, the composition may be provided in a patch or layer applied to the inner surface of the wrapper surrounding the filter material to form a filter element.

It is possible to make filters and filter elements from filter material and with a composition as described herein using conventional processes, techniques, and apparatus.

According to a third aspect of the present invention, there is provided a smoking article comprising a composition according to the first aspect or a filter element according to the second aspect.

As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn products. The smoking article may be provided with a filter for the gaseous flow drawn by the smoker.

Figure 2:
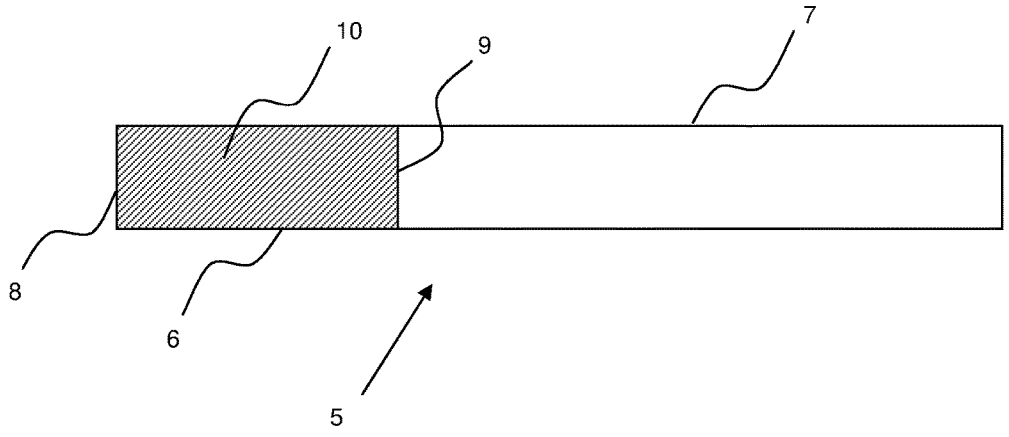
FIG. 2 is a schematic side view of a smoking article including a filter according to one embodiment of the invention.

FIG. 2, for purpose of illustration and not limitation, shows a smoking article 5 according to some embodiments of the third aspect of the invention. Smoking article 5 comprises a filter 6 and a cylindrical rod of smokeable material 7, such as tobacco, aligned with the filter 6 such that one end of the smokeable material rod 7 abuts the end of the filter 6. The filter 6 is wrapped in a plug wrap (not shown) and the smokeable material rod 7 is joined to the filter 6 by tipping paper (not shown) in a conventional manner. The filter 6 is substantially cylindrical and has a mouth end 8 and a smokeable material end 9. The filter 6 comprises a plug of filter material 10. Dispersed within the filter material is the composition of the present invention (not shown).

The plug of filter material preferably has a size and shape suitable to match the size and shape of the rod of smokeable material to which it may be attached in a finished smoking article.

Although the illustrated smoking article 5 includes a filter 6 having a single filter element or segment comprising an ion exchange resin as described herein, other arrangements are possible. For instance, the filter 6 can comprise multiple segments, such as 2, 3 or more segments, with some or all of the segments comprising a composition according to the invention.

In some embodiments, the composition according to the invention may be incorporated into a smoking article in a section separate from the filter.

Figure 3:
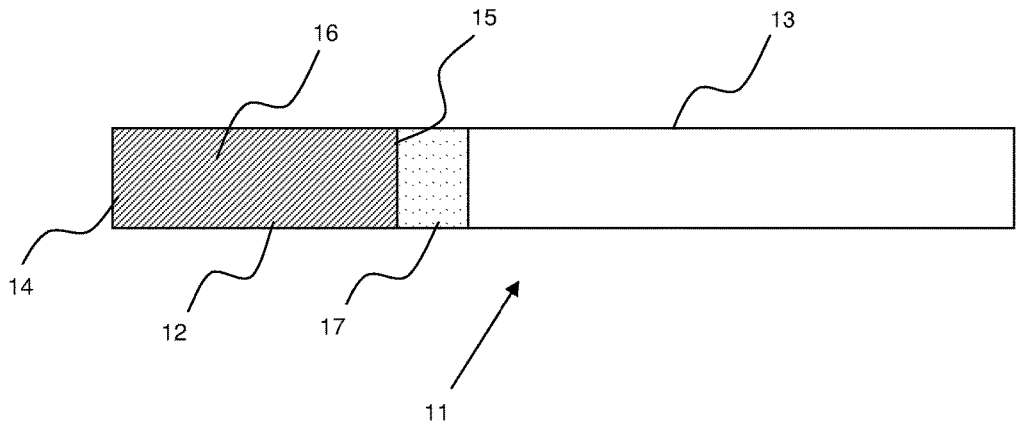
FIG. 3 is a schematic cross-section of a smoking article including a composition according to one embodiment of the invention.

FIG. 3, for the purpose of illustration and not limitation, shows a smoking article 11 according to some embodiments of the third aspect of the invention. It shows a smoking article 11 comprising a filter 12 aligned and abutted to a section 17, aligned and abutted to a cylindrical rod of smokeable material 13, such as tobacco. The filter 12 is wrapped in a plug wrap (not shown) and the smokeable material rod 13 is joined to section 17 and the filter 12 by tipping paper (not shown) in a conventional manner. The filter 12 is substantially cylindrical and has a mouth end 14 and a smokeable material end 15. The filter 12 comprises a plug of filter material 16. Section 17 comprises the composition of the present invention (not shown).

Many different filter arrangements for smoking articles are contemplated, including to composite filters wherein the filter comprises a plurality of separate filter elements or sections with different filtering capacities, and/or comprising different materials, such as different filter materials and additives, such as adsorbents and flavourants.

According to a fourth aspect of the present invention, there is provided a method of preparing the composition of the invention. In particular, there is provided a method comprising the deposition of additive particles onto an ion exchange resin from the solid and/or liquid phase of an aerosol.

In the method, additive particles may be deposited from an aerosol onto an ion exchange resin over one or more steps. In some embodiments, the particles may be deposited over more than one step in order to maximise the amount of additive particles deposited onto the resin.

One or more types of additive particle may be deposited. In some embodiments, additive particles of one type may be deposited. In other embodiments, more than one type of particle may be deposited and, in these embodiments, the different types of particle may be deposited simultaneously and/or sequentially.

Additive particles may be deposited onto a resin from an aerosol inside a chamber. In these embodiments, the chamber may be closed or open, and may be closed or open for the entire deposition process or just a part thereof. "Closed" in this context means that the chamber exchanges aerosol with the surroundings at a sufficiently low rate to be considered negligible. "Open" in this context means that the chamber exchanges aerosol with the surroundings at a sufficiently high rate to be considered significant. In some embodiments, the chamber may be closed to promote the deposition of additive particles onto the resin.

In embodiments wherein deposition takes place inside a chamber, any suitable chamber may be used. In some embodiments, a suitable chamber comprises walls substantially impermeable to the additive particles.

Certain physical conditions, such as temperature and pressure, may be adjusted or controlled in the method of the invention. They may be held constant or may be varied. The optimum set of conditions for the method may depend on a number of factors, such as the nature of the resin, the nature of the additive, and the properties desired of the composition made using the method.

Different combinations of physical conditions can be used to make compositions with different properties. In particular, different combinations of physical conditions can be used to make ion exchange resins with different amounts of additive particles on their surface and different filtration characteristics. In some embodiments, the combination of physical conditions may be tailored to the properties desired of the composition made using the method.

Temperature may be an important physical condition to control in the method. In some embodiments, it may be held constant. In some embodiments, it may be varied. In some embodiments, it may be left at ambient temperature for all of the method. In some embodiments, it may be held at a temperature higher or lower than ambient temperature for all of, or part of, the method. In some embodiments, it may be controlled as necessary to promote the deposition of additive particles onto the resin.

Alternatively or in addition, pressure may be an important physical condition to control in the method. In some embodiments, it may be held constant. In some embodiments, it may be varied. In some embodiments, it may be left at atmospheric pressure for all of the method. In some embodiments, it may be held at a pressure higher or lower than atmospheric pressure for all of, or part of, the method. In some embodiments, it may be controlled as necessary to promote the deposition of additive particles onto the resin.

Additive particles may be deposited onto the resin over any suitable length of time in the method. The optimum length of time will depend on a number of factors, such as the nature of the resin, the nature of the additive, the properties desired of the composition made using the method, and the physical conditions being used in the method. In some embodiments, the length of time may be tailored to the properties desired of the composition made using the method.

In some embodiments, it may be beneficial to deposit additive particles over a longer period of time to increase the amount of additive particles and the amount of additive deposited onto the resin. Increasing the amount of additive particles deposited onto the resin can provide a composition capable of delivering a stronger flavour and/or odour to tobacco smoke. In some embodiments, it may be beneficial to deposit additive particles over a shorter period of time to reduce the energy and monetary costs incurred by using the method.

In some embodiments, a resin may be exposed to an aerosol for a length of time sufficient for the system to reach thermodynamic equilibrium, meaning that the amount of additive particles on the resin surface would not significantly change if the system were left for longer. Allowing the system to reach thermodynamic equilibrium may maximise the amount of additive molecules deposited onto the resin which, in turn, may provide a composition capable of delivering a stronger flavour and/or aroma to tobacco smoke.

In some embodiments, a resin may be exposed to an aerosol for a length of time insufficient for the system to reach thermodynamic equilibrium, meaning that the amount of additive particles on the resin surface would significantly change if the system were left for longer. Preventing the system from reaching thermodynamic equilibrium may provide another means for controlling the amount of additive particles deposited onto the resin. By preventing the system reaching thermodynamic equilibrium, the amount of additive particles deposited onto the resin surface may be controlled by changing the duration of deposition rather than, or in addition to, the physical conditions.

In some embodiments, the method of the invention may comprise depositing additive particles onto a resin wherein the additive particles comprise molecules derived from eucalyptus.

EXPERIMENTAL WORK

Experiments were carried out to investigate the extent to which an ion exchange resin can retain its ability to adsorb toxicants whilst having previously been exposed to an aerosol, using tobacco smoke as an example. The experiments showed that an ion exchange resin can be exposed to tobacco smoke multiple times and retain its ability to adsorb smoke toxicants effectively.

The ion exchange resin tested in the experiments was a DIAION® CR20 ion exchange resin, supplied by the Mitsubishi Chemical Company. Some of the properties of the ion exchange resin are shown in Table 1.

TABLE 1

| | |
|---|---|
| Resin | Diaion ® CR2O |
| Particle Shape | Spherical |
| Mean Particle Diameter (mm) | 0.60 |
| Density (g $cm^{-3}$) | 0.64 |
| *Surface Area ($m^2$ $g^{-1}$) | 44 |
| *Total Pore Volume ($cm^3$ $g^{-1}$) | 0.08 |
| Functional group | Amine |

*Measured by nitrogen adsorption at 77 K.

All cigarettes used in the method were unventilated Virginia KS cigarettes that had been stored for 48 hours at 22° C. and 60% relative humidity before being smoked. All of them were smoked under the ISO machine regime (i.e. one 35 ml puff for 2 s every 60 s).

A predetermined weight (60 mg) of the ion exchange resin was weighed into the recess filter of a cigarette. The cigarette was smoked. The same resin was immediately transferred to another, unused cigarette. This cigarette was immediately smoked. This was repeated multiple times. The same batch of material was therefore used to filter tobacco smoke in multiple cigarettes in quick succession.

The filtered smoke chemistry was analysed by taking the mean of three replicates using High Performance Liquid Chromatography (HPLC). HPLC was used to measure the concentration of acetaldehyde, acetone, acrolein, butyraldehyde, crotonaldehyde, formaldehyde, MEK, and propionaldehyde. The percentage reduction of each individual smoke component was then calculated as a function of cigarette use.

Figure 4:
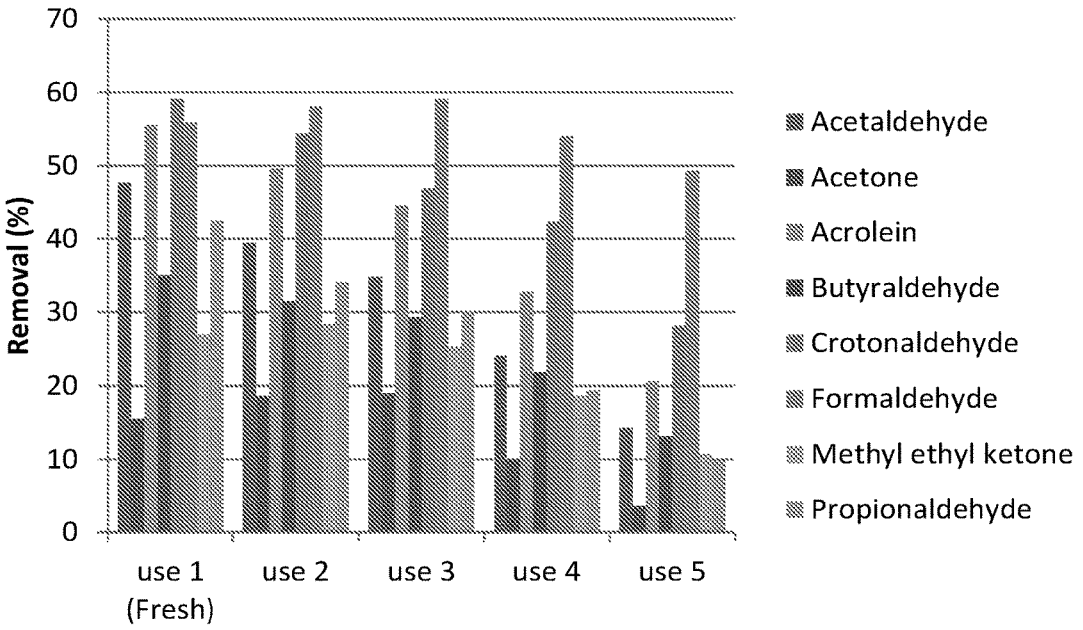
FIG. 4 is a graph showing how the extent to which certain compounds are adsorbed to an ion exchange resin depends on the number of cigarettes in which the resin has been used.

FIG. 4 shows the graph prepared from the data collected using HPLC and the 60 mg ion exchange resin. The graph shows that as the number of cigarettes smoked increases, the extent to which the ion exchange resin removes compounds decreases. Thus, the extent to which an ion exchange resin removes compounds depends on the mass of the resin, the compound being adsorbed, and the number of times the cigarette has already been used.

The graph also shows that the resin retains its ability to adsorb compounds effectively after being used in 5 cigarettes. This indicates that an ion exchange resin can be exposed to aerosol multiple times without losing its ability to adsorb.

Worthy of note is the high percentages of acetaldehyde and (particularly) formaldehyde removed from tobacco smoke by the DIAION® CR20 resin, as well as the small extent to which these percentages decreases with each cigarette smoked. The amine groups of the DIAION® CR20 resin have a high affinity for formaldehyde and acetaldehyde, making the resin useful for the filtration of tobacco smoke.

CONCLUSIONS

The following conclusions may be made from the experimental work:

1) DIAION® CR20 ion exchange resin can be exposed to tobacco smoke (i.e. solid-phase aerosol) multiple times and retain its ability to effectively adsorb many different compounds, especially formaldehyde.
2) The extent to which an ion exchange resin retains its ability to adsorb a compound depends on the compound being adsorbed.
3) DIAION® CR20 ion exchange resin has a strong odour after being exposed to tobacco smoke (i.e. solid-phase aerosol). The strength of the odour increases with the number of cigarettes used.

In order to address various issues and advance the art, the entirety of this disclosure shows by way of illustration various embodiments in which the claimed invention may be practiced and provide for superior filtration media. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A composition for inclusion in a smoking article comprising an ion exchange resin and additive particles comprising an additive on the surface of the ion exchange resin, wherein the ion exchange resin has functional groups for ion exchange and the additive particles are not bonded to the functional groups, and wherein the additive is released from the composition by volatilization.

2. A composition according to claim 1, wherein the additive is released from the additive particles and at least some additive becomes entrained in the smoke being drawn through the smoking article upon use.

3. A composition according to claim 1, wherein the additive is a volatile or semi-volatile material.

4. A composition according to claim 1, wherein the additive is a flavour and/or aroma.

5. A composition according to claim 4, wherein the flavour and/or aroma is a plant compound or derivative thereof.

6. A composition according to claim 1, wherein the ion exchange resin comprises ion exchange resin beads.

7. A composition according to claim 1, wherein the ion exchange resin has one or more of the following properties: a mean bead diameter of from about 20 to about 1200 μm; a BET surface area of from about 10 to about 300 $m^2/g$; a mass density of from about 0.1 to about 1 $g/cm^3$; and a total exchange capacity of from about 0.5 to about 2 $meq/cm^3$.

8. A composition according to claim 1, comprising at least one of sandalwood, eucalyptus, anise, and cedar.

9. A smoking article filter element, wherein the smoking article filter element comprises a composition according to claim 1.

10. A smoking article comprising a composition according to claim 1.

11. A smoking article comprising a smoking article filter element according to claim 9.

12. A method of preparing a composition comprising an ion exchange resin and additive particles comprising an additive, the method comprising the deposition of additive particles onto the ion exchange resin from the solid and/or liquid phase of an aerosol.

13. A method according to claim 12, wherein the additive particles are deposited onto an ion exchange resin inside a closed chamber.

* * * * *